US005749680A

United States Patent [19]

Hilfiker et al.

[11] Patent Number: 5,749,680

[45] Date of Patent: May 12, 1998

[54] WIRE MAT CONNECTOR

[75] Inventors: William K. Hilfiker, 3718 Grapevine Dr., Grepevine, Tex. 76051; Thomas P. Taylor, Euless, Tex.

[73] Assignee: William K. Hilfiker, Grapevine, Tex.

[21] Appl. No.: 743,191

[22] Filed: Nov. 5, 1996

[51] Int. Cl.[6] ..... E02D 29/02

[52] U.S. Cl. ..... 405/262; 405/284; 405/286

[58] Field of Search ..... 405/262, 284, 405/285, 286, 258, 273, 272

[56] References Cited

U.S. PATENT DOCUMENTS

| | | | |
|---|---|---|---|
| 4,324,508 | 4/1982 | Hilfiker et al. | 405/284 |
| 4,514,113 | 4/1985 | Neumann | 405/262 X |
| 4,929,125 | 5/1990 | Hilfiker | 405/262 |
| 4,961,673 | 10/1990 | Pagano et al. | 405/262 X |
| 5,044,833 | 9/1991 | Wilfiker | 405/267 |
| 5,582,492 | 12/1996 | Doyle | 405/284 X |

FOREIGN PATENT DOCUMENTS

| | | | |
|---|---|---|---|
| 427-221-A | 5/1991 | European Pat. Off. . | |
| 60-138121 | 7/1985 | Japan . | |
| 3-144014 | 6/1991 | Japan . | |
| 405039613 A | 2/1993 | Japan | 405/262 |
| 6-41994 | 2/1994 | Japan . | |

*Primary Examiner*—Dennis L. Taylor
*Attorney, Agent, or Firm*—Limbach & Limbach LLP

[57] ABSTRACT

A soil reinforced retaining wall includes a soil reinforcing mat connected to a face panel. The face panel is vertically disposed with a back facing the earthen formation and is preformed to include an anchor embedded in the face panel and extending from the back in at least one predetermined location. The soil reinforcing mats are horizontally disposed within the earthen formation in general correspondence with the predetermined location. The mats have an end adjacent the face panel folded to form substantially a right angle portion of the mat including a vertical face and a horizontal face. A right angle member having a vertical face and a horizontal face is disposed in contact with the corresponding vertical face and horizontal face of the right angle portion of the mat. The right angle member is then secured to the anchor such that the right angle portion of the mat is rigidly held therebetween.

28 Claims, 7 Drawing Sheets

WIRE MAT CONNECTOR

BACKGROUND OF THE INVENTION

The present invention relates to reinforced soil retaining walls for earthen formations, and more particularly, to such a wall having an improved connection between the face panels and the soil reinforcing elements.

Soil reinforced retaining wall structures for retaining earthen formations are generally known. For example, in one known structure, precast concrete face panels are vertically disposed in front of an earthen formation, soil reinforcing elements are horizontally disposed in a vertically spaced generally parallel relationship within the earthen formation as it is built, and the soil reinforcing elements are connected in some manner to the back of at least some of the face panels. Typically, the soil reinforcing elements take the form of a rectangular mat having longitudinal and transverse steel wires welded together in a spaced orthogonal relationship.

Various methods for securing the reinforcing elements to the face panels are known, such as shown in U.S. Pat. No. 4,324,508 and in U.S. Pat. No. 5,044,833. However, it remains desirable to find improved methods offering greater resistance to corrosive and shear forces inherent in such structures.

SUMMARY OF THE INVENTION

In its broadest aspects, the present invention is concerned with a soil reinforced retaining wall having one or more soil reinforcing mats connected to one or more face panels. The face panel is vertically disposed with a back face facing the earthen formation and is preformed to include an anchor embedded in the face panel and extending from the back face in at least one predetermined location. The soil reinforcing mat is horizontally disposed within the earthen formation in general correspondence with the predetermined location. The mat has an end adjacent the face panel folded to form substantially a right angle portion of the mat including a vertical face and a horizontal face. A right angle member having a vertical face and a horizontal face is disposed in contact with the corresponding vertical face and horizontal face of the right angle portion of the mat. The right angle member is then secured to the anchor such that the right angle portion of the mat is rigidly held therebetween.

In one preferred embodiment, the anchor includes a right angle bracket having a vertical face affixed to the back of the face panel and a horizontal face extending therefrom. A T-anchor extension bracket has a longitudinal plate coupled at one end to the horizontal face of the angle bracket and a transverse plate at the other end. The transverse plate of the T-anchor extension bracket is secured to the horizontal face of the right angle member such that the soil reinforcing mat is held rigidly therebetween.

In a particularly preferred embodiment, the longitudinal plate of the T-anchor extension bracket is rotatably coupled to the horizontal face of the angle bracket.

In another embodiment, the anchor is a J-bolt which is precast into the face panel with a threaded portion extending from the back face thereof. The J-bolt is secured to the horizontal face of the right angle member such that the soil reinforcing mat is held rigidly against the face panel by the right angle member.

In another embodiment, the anchor is a threaded insert which is precast into the face panel with a threaded portion accessible from the back face thereof. The right angle member is bolted to the threaded insert such that the soil reinforcing mat is held rigidly against the face panel by the right angle member.

In another embodiment, the anchor is a U-bolt which is precast into the face panel with a looped portion defining a horizontal opening extending from the face panel and through openings in the right angle member. A rod inserts through the looped portion to secure against the horizontal face of the right angle member such that the soil reinforcing mat is held rigidly between the right angle member and the face panel.

In several of the embodiments, the anchor is positioned in a recess in the face panel. The recess includes a shelf which provides lateral support for the connection including the right angle member held against the right angle portion of the mat held against the face panel.

A principal object of the present invention is to provide an improved connection between mats and face panels in the construction of a reinforced soil retaining wall.

Another object is to provide a connection having shear forces well distributed along the width of the mat.

Still another obejct is to provide an improved connection between the mats and face panels of a soil reinforced wall which enables the mats to be positioned to accomodate obstructions within the soil.

A further object of the invention is to provide for the connection of welded wire mats of a soil reinforced wall to face panels in a manner which equally stresses the longitudinal wires of the mats.

These and other objects and advantages will become apparent by reference to the following detailed description and accompanying drawings which set forth several illustrative embodiments in which the principles of the invention are utilized.

DETAILED DESCRIPTION OF THE INVENTION

Figure 1:
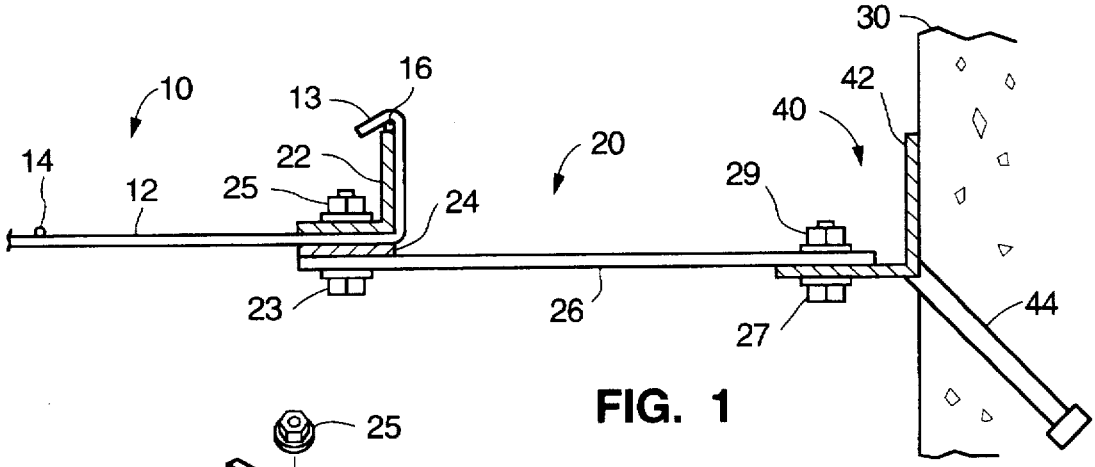
FIG. 1 is an elevational view showing one embodiment of the connection of elements in a soil reinforced retaining wall structure according to the present invention.
Figure 2:
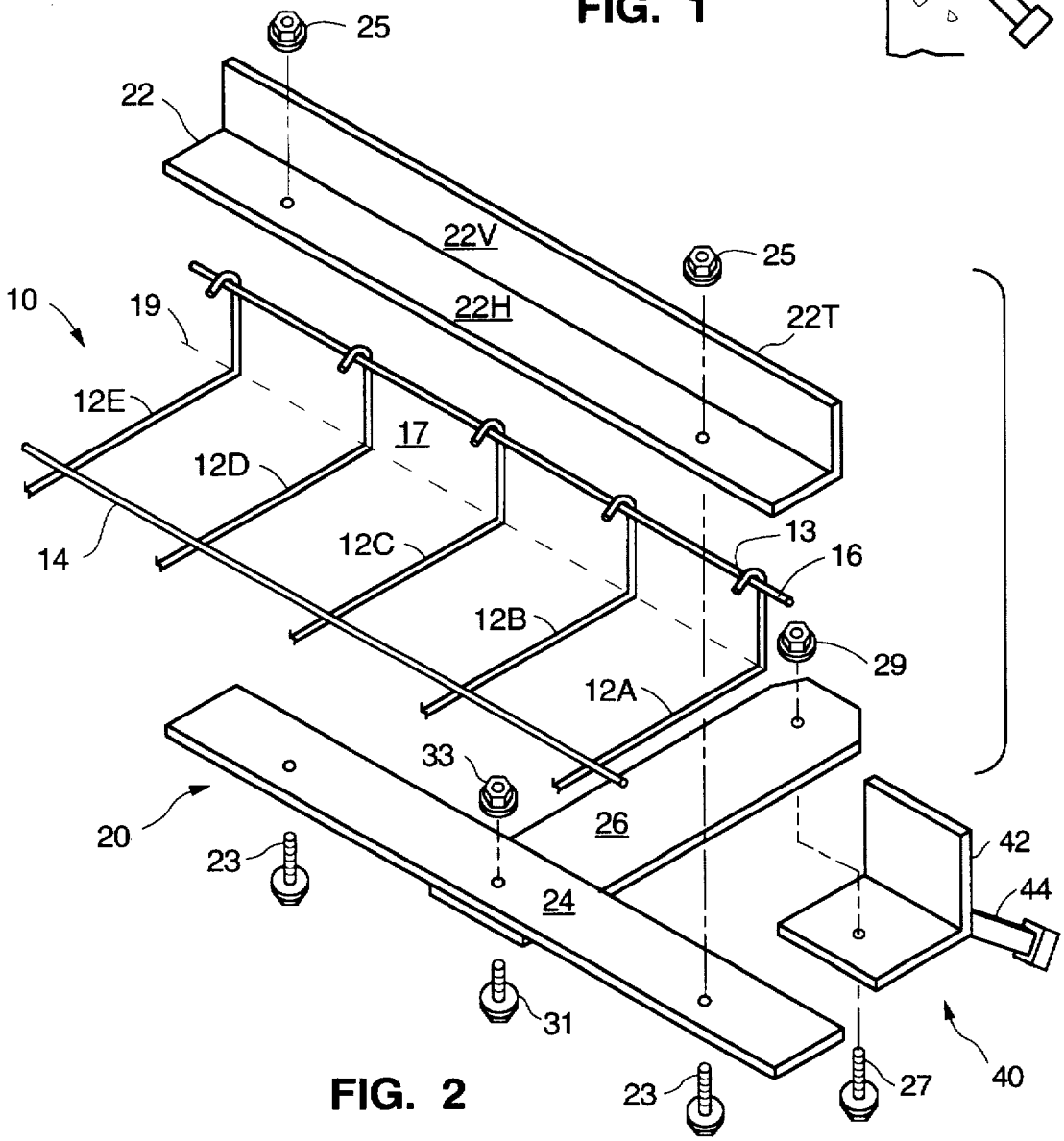
FIG. 2 is an exploded perspective view of the connection shown in FIG. 1.
Figure 3:
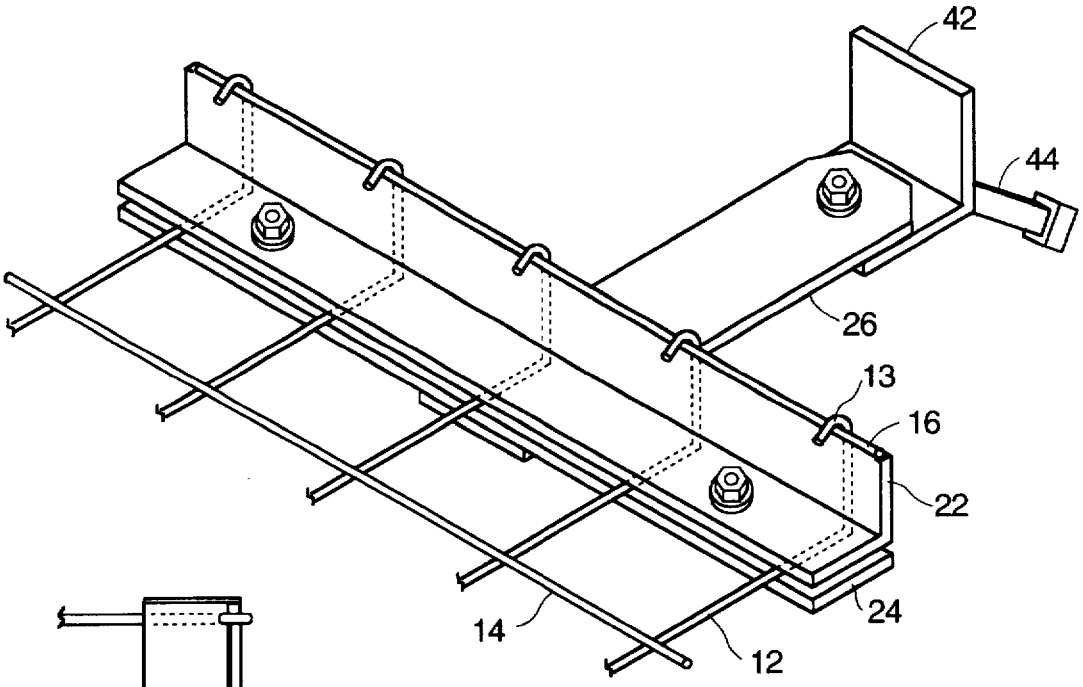
FIG. 3 is perspective view of the connection shown in FIG. 2.
Figure 4:
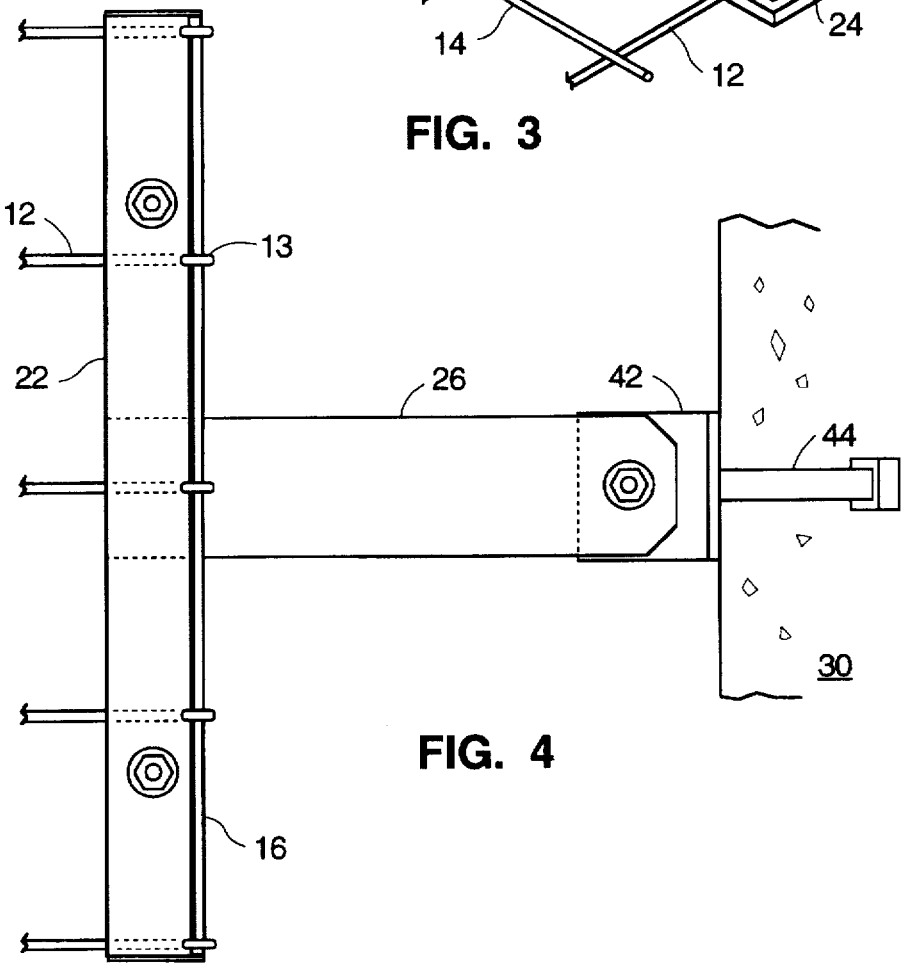
FIG. 4 is top plan view of the connection shown in FIG. 1.

The present invention is a soil reinforced retaining wall structure for retaining earthen formations. The retaining wall structure includes one or more face panels vertically disposed in front of the earthen formation. The face panels are preformed to have an appropriate size and shape depending on the application, and are typically precast of concrete or polymer reinforced concrete in a conventional manner.

Soil reinforcing elements are horizontally disposed in a vertically spaced generally parallel relationship within the earthen formation. The soil reinforcing elements generally take the form of a rectangular mat having longitudinal and transverse steel wire members welded together in a spaced orthogonal relationship.

In accord with the present invention, the end of a mat adjacent a face panel is folded at a right angle parallel with the transverse members such that a plurality of longitudinal members form a protruding right angle face. The protruding right angle face of the mat is utilized to secure a connection to the face panel, either directly or via an extension bracket, as will now be described in more detail.

DESCRIPTION OF THE FIRST EMBODIMENT

A first embodiment of the invention is illustrated in FIGS. 1–4. A soil reinforcing mat 10 includes a plurality of longitudinal members, such as members 12A through 12E, and a plurality of transverse members, such as members 14 and 16. The longitudinal members are generally parallel and spaced apart from each other. Likewise, the transverse members are generally parallel and spaced apart from each other. The longitudinal members and transverse members are preferably steel wires which are welded together at their intersections to form a rectangular grid pattern. Other materials are also contemplated as suitable for forming the grid, such as reinforced polymer, and other geometries for the reinforcing elements could also be implemented. The size and spacing of the wires or other materials will, of course, depend on the application, and will be apparent to those having skill in this art.

In accord with the present invention, the last transverse section of the mat 10, i.e., the section bounded by transverse members 14 and 16, is folded or bent upwardly ninety degrees at fold line 19 (shown as a dashed line) to form a right angle relative to the mat and thereby providing a right angle or vertical planar face 17. A right angle structural member 22, preferably a piece of structural angle iron, is then set against the fold line 19 such that the vertical face 22V of the angle iron 22 is held flush against each of the longitudinal members 12. The angle iron 22 is then secured in place by coupling it to a T-anchor extension plate 20 via bolts 23 and nuts 25 such that the mat 10 is rigidly held therebetween.

The fold line 19 of mat 10 is preferably positioned based on the height of the vertical face 22V such that transverse member 16 will be in contact with the top face 22T of the angle iron. Typically, the fold of mat 10 will be performed during field installation. Thus, the mat 10 has both bearing and frictional contact with the angle iron 22. For example, in a preferred embodiment, the angle iron 22 is a standard steel angle measuring ¼ inch in thickness by 2½ inches high by 2½ inches deep. The transverse dimension is completely application dependent and may be varied or selected according to need.

Further, the longitudinal members 12 preferably include protruding ends 13 which are bent over the top of transverse member 16 in the field to provide additional resistance to shear forces.

The T-anchor plate 20 includes a transverse plate 24 and a longitudinal plate 26. The longitudinal plate 26 is connected to an anchor clip 40 via bolt 27 and nut 29. The plates 24 and 26 are connected either fixedly by a weld or rotatably by a bolt 31 and nut 33. The bolt connection permits the plates 24 and 26 to be rotated relative to each other. The anchor clip is preferably a small piece of structural ¼ inch thick angle iron 42 measuring 3½ inches high by 3½ inches deep by 3½ inches long and which is pre-cast onto the back side of wall or face panel 30. The anchor clip 40 preferably includes a stud 42 which is welded to the right angle bracket 42 and also pre-cast into the wall 30, for example, a ¾ inch diameter Nelson stud.

The face panel 30 is preferably precast from polymer-reinforced concrete to include one or more anchor clips 40 in appropriate predetermined locations on the back of the face panel.

One advantage of the present invention is that the T-anchor plate 20 (and the connected mat 10) may be rotated on the anchor clip 40 to avoid vertical obstructions, as will now be illustrated with reference to FIGS. 5 and 6.

Figure 5:
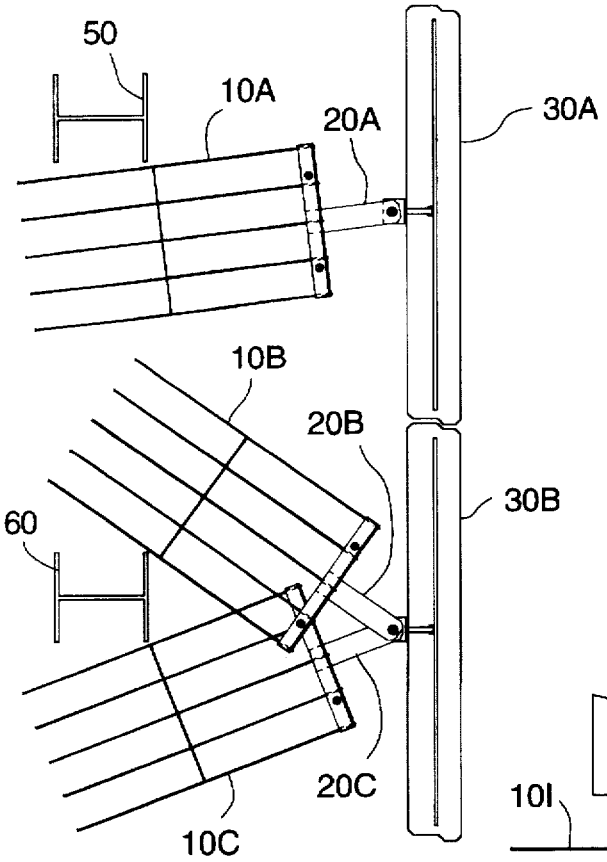
FIG. 5 is a top plan view showing a structure wherein soil reinforcing mats are rotated relative to face panels to avoid vertical obstructions.

In FIG. 5, a pair of vertical obstructions 50 and 60 are located in an earthen formation directly behind face panels 30A and 30B, respectively. The mat 10A and corresponding T-anchor 20A are rotated on the anchor clip (not shown) then secured in the rotated position with nut and bolt to avoid the obstruction 50 behind face panel 30A. Likewise, mats 10B and 10C with corresponding T-anchors 20B and 20C, which are vertically spaced apart within the earthen formation, are rotated on respective anchor clips (not shown) to avoid the obstruction 60 behind face panel 30B.

Figure 6:
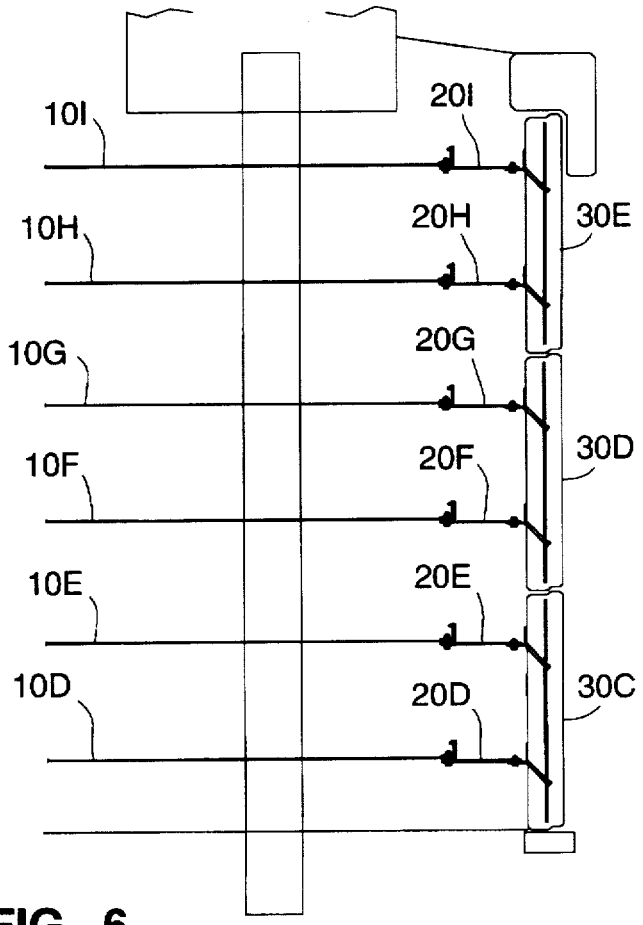
FIG. 6 is an elevational view of the structure shown in FIG. 5.

FIG. 6 more clearly illustrates the vertical spacing of mats within an earthen formation. For example, mats 10D and 10E are connected via respective T-anchors 20D and 20E to face panel 30C; mats 10F and 10G are connected via respective T-anchors 20F and 20G to face panel 30D; and finally, mats 1OH and 10I are connected via respective T-anchors 20H and 20I to face panel 30E.

DESCRIPTION OF THE SECOND EMBODIMENT

Figure 7:
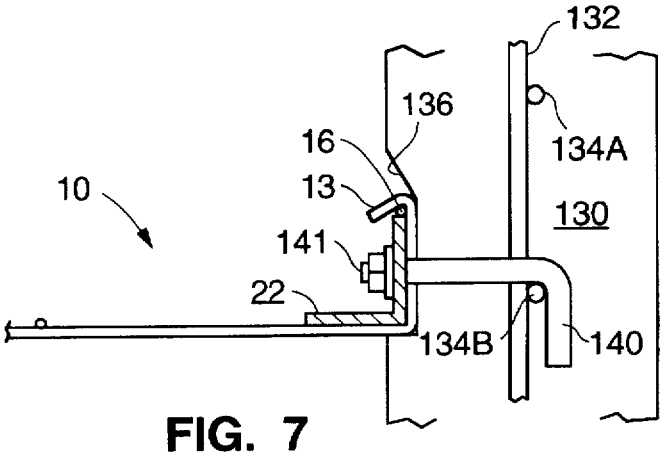
FIG. 7 is an elevational view of an alternative embodiment of the connection of elements in a soil reinforced retaining wall structure according to the present invention.
Figure 8:
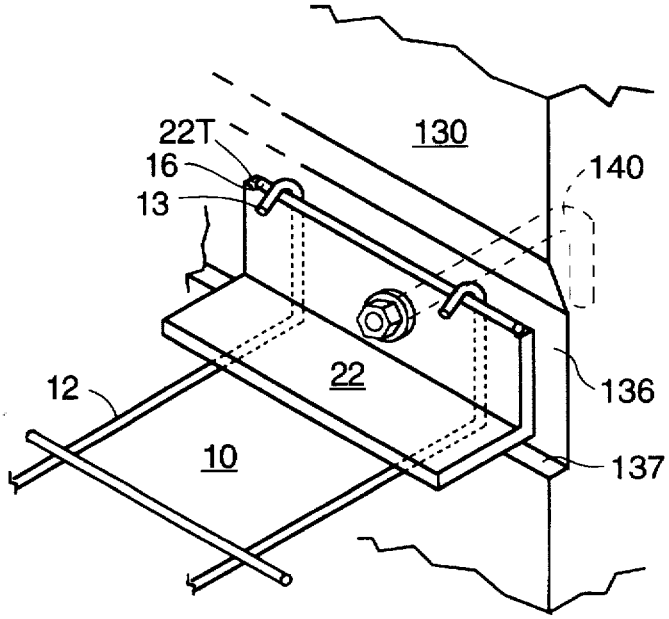
FIG. 8 is perspective view of the structure shown in FIG. 7.

A second embodiment of the invention is illustrated in FIGS. 7 and 8. In this embodiment, the face grid 130 includes a reinforcing grid 132 which is pre-cast into the face panel. The reinforcing grid 132 includes a plurality of transverse members, such as members 134A and 134B, which are pre-cast into the face panel in front of the reinforcing grid to provide additional lateral strength for the anchors, such as J-bolt 140. J-bolt 140 is also pre-cast into the face panel 130 such that a threaded portion 141 of the J-bolt extends through the rear of the face panel and the inside of the "J" bend wraps downwardly over transverse member 134B.

Figure 9:
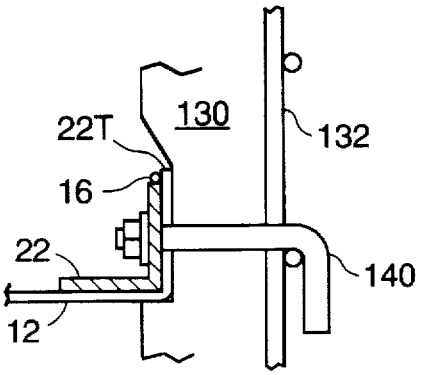
FIG. 9 is an elevational view of a variation on the structure shown in FIG. 7.

The face panel is preferably formed to have a recess 136 on the back side thereof including a shelf or step 137. The threaded portion of J-bolt 140 extends through a central region of the recess 136 and through a corresponding hole (not shown) in the angle iron 22 to directly bolt the angle iron to the face panel 130. The angle iron 22 thus sits on the shelf 137 within the recess 136. As in the first embodiment, the transverse wire 16 contacts the top edge 22T of angle iron 22, and the protruding ends 13 of wires 12 are bent over the top edge 22T of the angle iron 22. However, as shown in FIG. 9, it may not be necessary to have protruding ends 13 of wires 12 to bend over the top edge 22T of angle iron 22.

Figure 10:
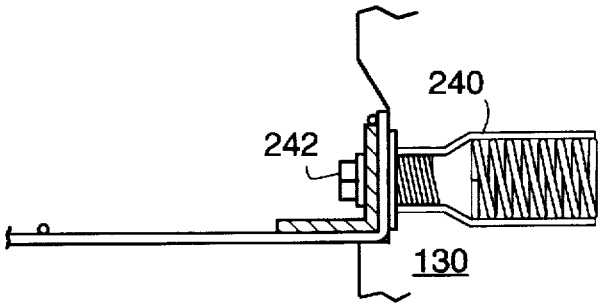
FIG. 10 is an elevational view of another variation on the structure shown in FIG. 7.

A variation of the second embodiment is shown in FIG. 10, wherein an threaded insert 240 is pre-cast into the face panel 130. A bolt 242 is inserted through a corresponding hole (not shown) in the angle iron 22 and mat 10 and screwed directly into the insert 240.

Figure 11:
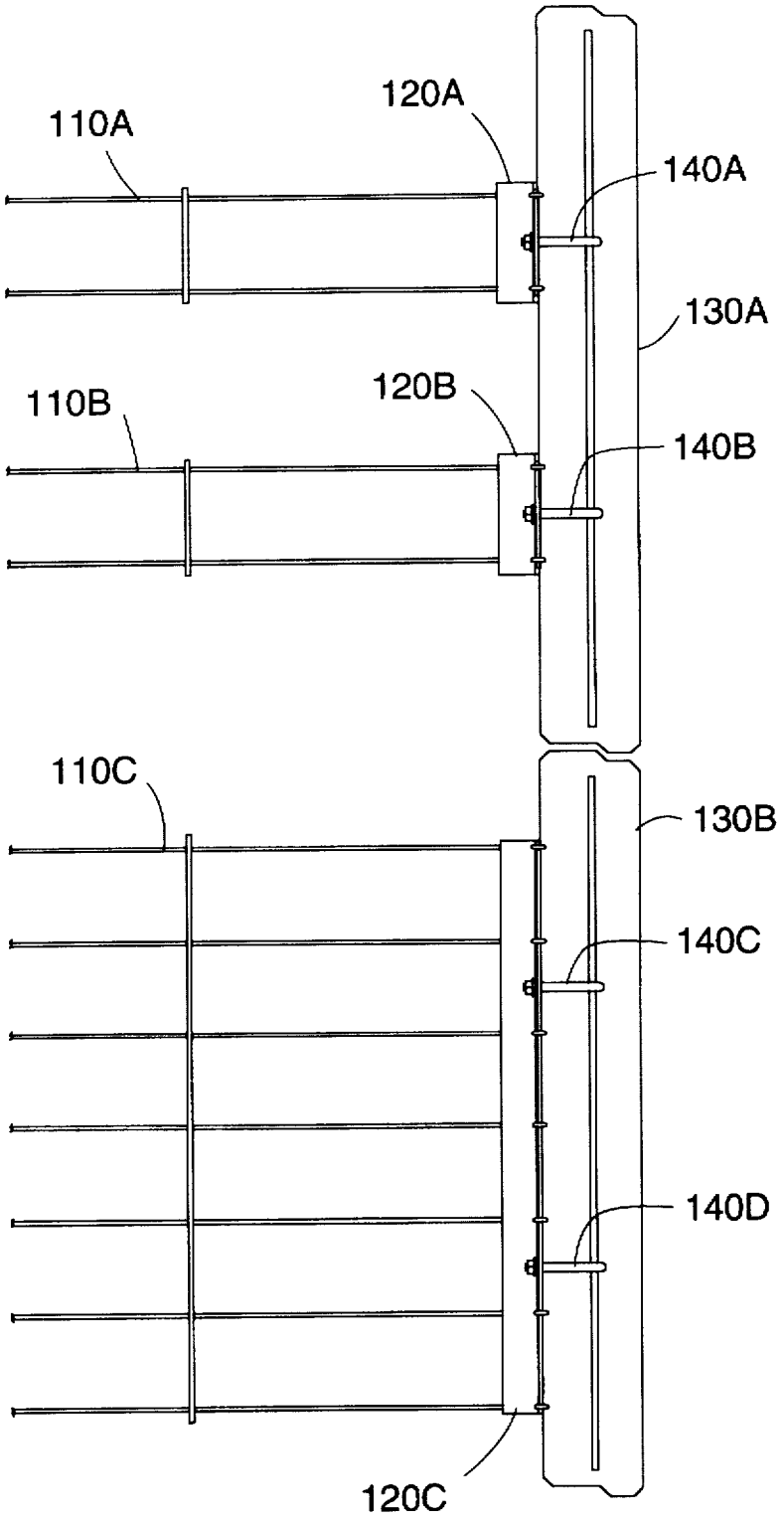
FIG. 11 is a top plan view showing a soil reinforced wall constructed with any of the embodiments shown in FIGS. 7–9.

FIG. 11 shows a top plan view of a typical retaining wall structure utilizing the connectors of the second embodiment. For example, a first face panel 130A has two narrow wire mats 110A and 110B coupled to it via respective right angle members 120A and 120B and J-bolts 140A and 140B. A second face panel 130B has one wide wire mat 110C coupled to it via right angle member 120C and J-bolts 140C and 140D. As would be obvious to one with skill in this technology, a wide variety of different configurations involving different mats, face panels and connections between the two, may be devised utilizing the principles of the present invention.

DESCRIPTION OF THE THIRD EMBODIMENT

Figure 12:
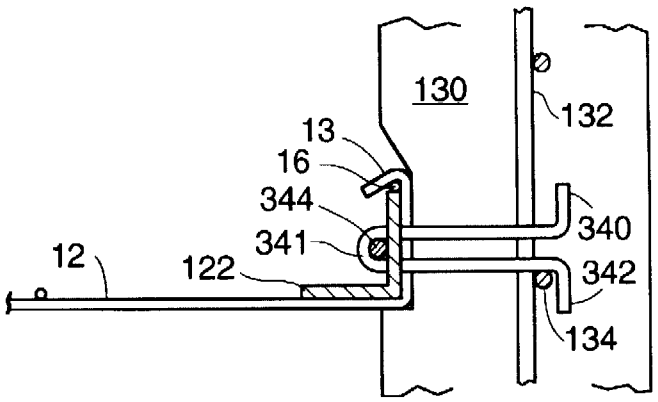
FIG. 12 is an elevational view of yet another alternative embodiment of the connection of elements in a soil reinforced retaining wall structure according to the present invention.
Figure 13:
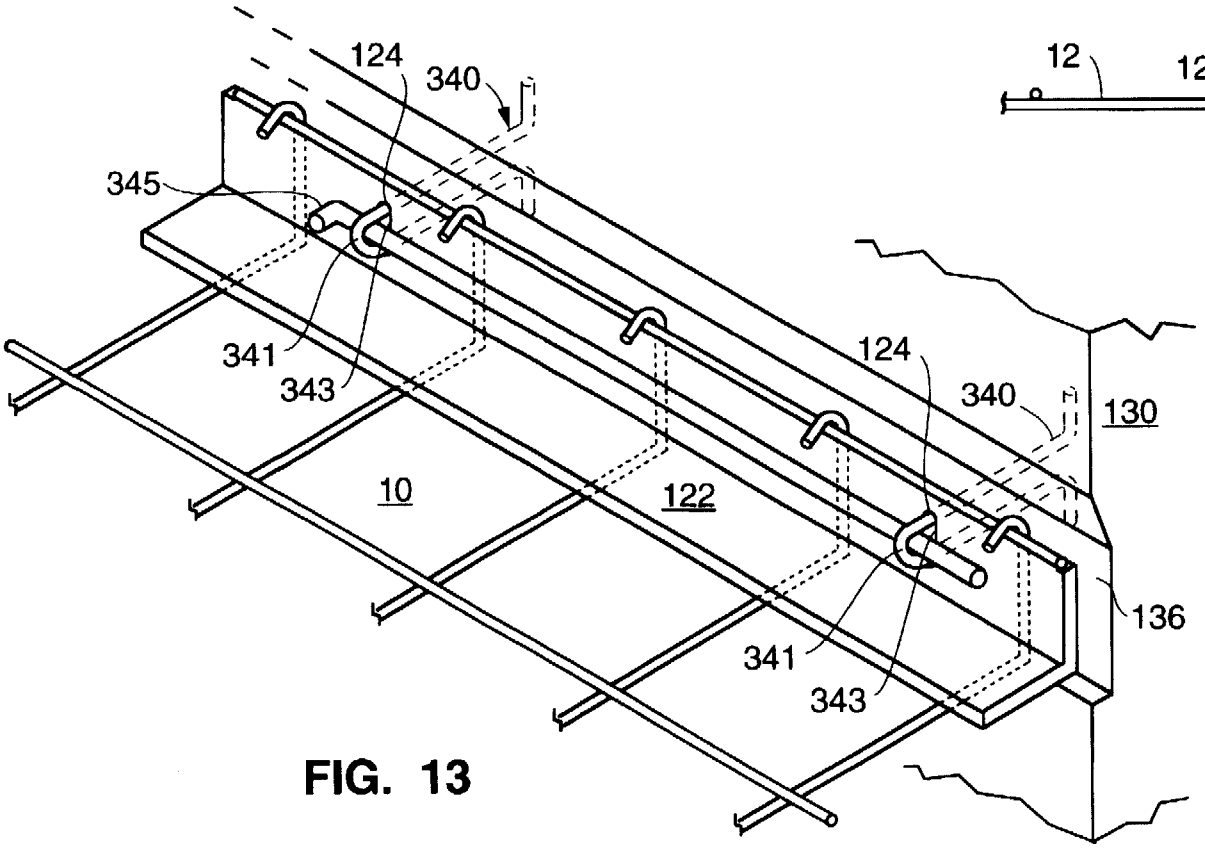
FIG. 13 is perspective view of the structure shown in FIG. 12.
Figure 15:
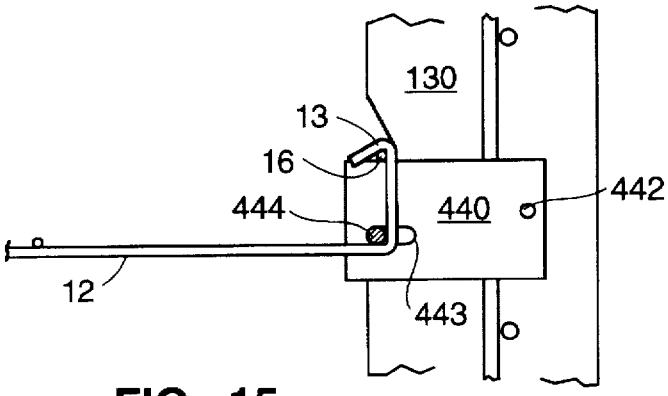
FIG. 15 is an elevational view of another alternative embodiment of the connection of elements in a soil reinforced retaining wall structure according to the present invention.

A third embodiment of the invention is illustrated in FIGS. 12–13. In this embodiment, one or more U-shaped anchors 340 are pre-cast into the face panel 130 such that the bight portion of the U-shape extends from the face panel to provide a vertical loop 341 having a horizontal opening. As in the second embodiment, a reinforcing grid 132 in the face panel 130 has transverse members 134, and the U-shaped anchors 340 preferably have at least one outwardly extending portion 342 that wraps downwardly around the transverse member 134 to provide additional rigidity to the anchor connection.

The angle iron 122 has slots 124 appropriately spaced apart on the vertical face thereof and positioned to receive therethrough the extended vertical loops 341 of anchors 340. The mat 10 with angle iron 122 are placed into the recess 136 in face grid 130 such that the vertical loops 341 of embedded anchors 340 extend through slots 124. The vertical loops 341 of anchor 340 extending through slots 124 define openings 343 between the bottom of the vertical loops 341 and the vertical face 122V of the angle iron 122. A rod 344 of suitable length is then inserted through all the openings 343 to secure the angle iron 122 against the vertical planar face formed by the longitudinal wires 12, which are in turn secured against the face panel 130 in recess 136. Preferably, rod 344 has a small L-shape 345 on one end thereof to facilitate pushing the rod all the way through the openings 343 to a terminal position. The rod may be tapered to provide a wedging effect as it is forced into place.

Figure 14:
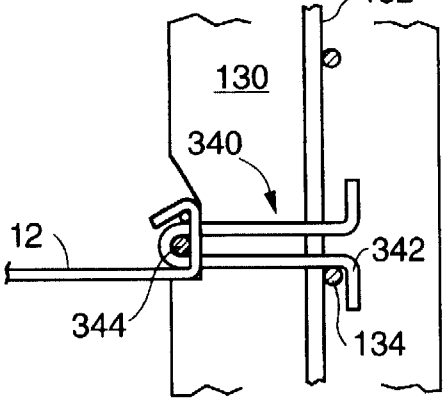
FIG. 14 is an elevational view of a variation on the structure shown in FIG. 12.

A variation on the third embodiment is shown in FIG. 14. In this embodiment, there is no angle iron positioned in the fold line of mat 10. Instead, the rod 344 secures directly against the vertical planar face formed by the longitudinal members 12.

DESCRIPTION OF THE FOURTH EMBODIMENT

A fourth embodiment is illustrated in FIGS. 15–19. An anchor plate 440 is pre-cast into the face panel 130. The anchor plate 440 is preferably a piece of flat steel plate which is vertically disposed within the face panel 130 and includes a lateral stud 442 to provide additional strength against pull-out. The anchor plate 440 extends from the back of the face panel 130 in correspondence with recess 136. A longitudinal slot 443 is provided on the portion of the anchor plate 440 that extends from the back of the face panel 130. The longitudinal members 12 are bent upwardly at the fold line and the anchor plate 440 extends between selected ones of the longitudinal members such that the transverse member 16 is in contact with the top edge 440T of the anchor plate 120. The protruding ends 13 of longitudinal members are preferably bent back over the top edge 440T, as in previous embodiments. A connecting rod 444 is inserted through each of the slots 443 and contacts each of the longitudinal members 12 in the vertical planar face of mat 10 to provide equal resistance. Like the rod 344, the rod 444 may be tapered to provide a wedging effect.

Figure 16:
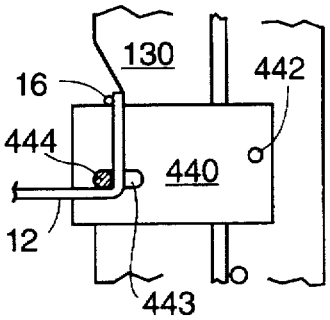
FIG. 16 is an elevational view of a variation on the structure shown in FIG. 15.
Figure 17:
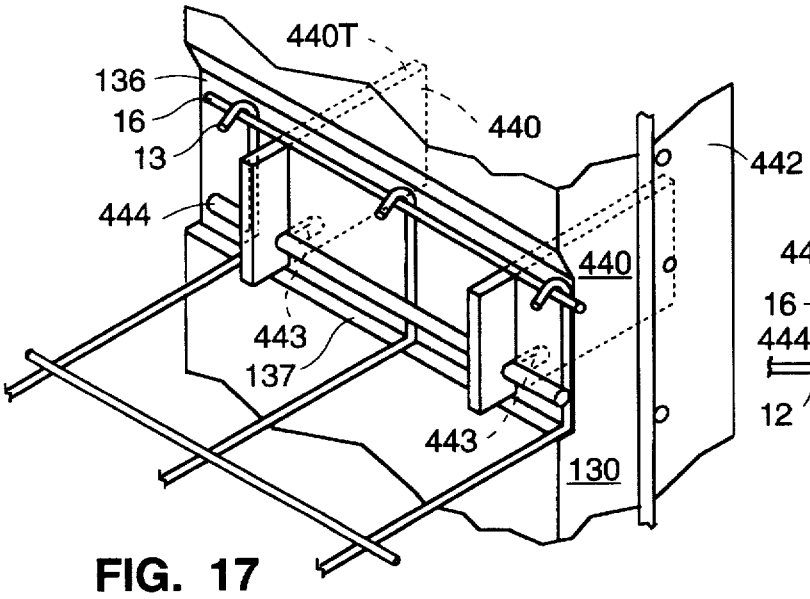
FIG. 17 is perspective view of the structure shown in FIG. 15.

A variation is illustrated in FIG. 16, wherein there are no protruding ends on longitudinal members 12 to wrap over the top edge 440T of anchor plate 440.

Figure 16A:
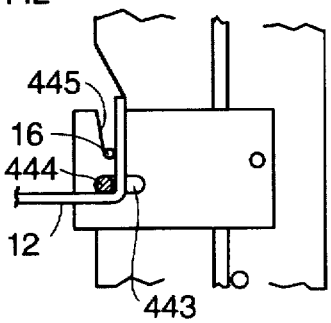
FIG. 16A is an elevational view of showing another variation on the structure shown in FIG. 15.

Another variation is illustrated in FIG. 16A, wherein a second slot 445 is oriented vertically on anchor plate 440 and open to the top for receiving the transverse wire 16.

Figure 19:
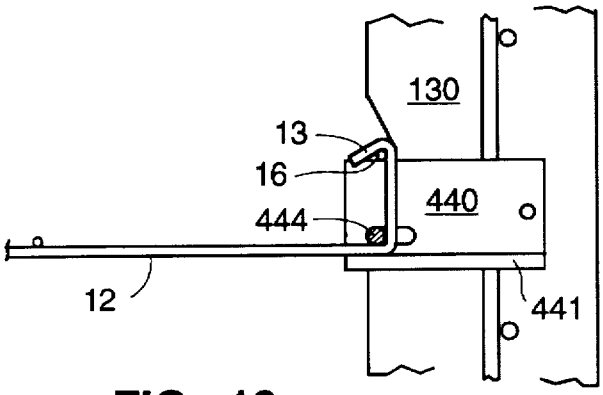
FIG. 19 is an elevational view of the structure shown in FIG. 15 incorporating the variation shown in FIG. 18.
Figure 18:
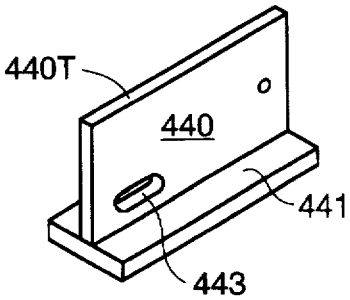
FIG. 18 is perspective view showing a variation of one of the elements in the structure shown in FIG. 17.

Finally, another variation is shown in FIGS. 18 and 19, wherein the anchor plate 440 includes a shelf 441, which is a horizontal protrusion from the plate. FIG. 18 shows the shelf 441 protruding from both sides of the plate 440, like a "T," but the shelf could also protrude only from one side of the plate like an "L," for example, if the plate was simply a piece of structural angle iron.

The shelf 441 provides additional resistance to shear forces because the longitudinal member 12 now has its horizontal component resting on shelf 441, the fold line wraps the longitudinal member around rod 444, and the transverse member 16 is in contact with the top edge 440T of the plate 440.

It should be understood that the invention is not intended to be limited by the specifics of the above-described embodiment, but rather defined by the accompanying claims.

We claim:

1. An apparatus for retaining an earthen formation, comprising:

a face panel vertically disposed with a back face facing the earthen formation and preformed to include an anchor embedded in the face panel and extending from the back face in at least one predetermined location, a soil reinforcing mat horizontally disposed within the earthen formation in general correspondence with the predetermined location, said mat having an end adjacent the face panel folded to form substantially a right angle portion of the mat including a vertical face and a horizontal face, first right angle member having a vertical face and a horizontal face disposed in contact with the corresponding vertical face and horizontal face of the right angle portion of the mat, and means for securing the first right angle member to the anchor such that the right angle portion of the mat is rigidly clamped therebetween.

2. The apparatus for retaining an earthen formation as in claim 1, wherein the anchor comprises a bolt embedded in the face panel and having a protruding portion including a threaded portion extending orthogonally from the back of the face panel and through the vertical face of the right angle portion of the mat and through the vertical face of the first right angle member, and wherein the securing means comprises a nut secured onto the threaded portion of the bolt such that the vertical face of the right angle portion of the mat is rigidly clamped between the vertical face of the first right angle member and the back of the face panel.

3. The apparatus for retaining an earthen formation as in claim 1, wherein the anchor comprises a threaded insert embedded orthogonally in the face panel and having an opening on the back of the face panel, and wherein the securing means comprises a bolt inserted sequentially through the vertical face of the first right angle member, the vertical face of the soil reinforcing mat, and the opening into the threaded insert such that the vertical face of the right angle portion of the mat is rigidly clamped between the vertical face of the first right angle member and the back of the face panel.

4. An apparatus for retaining an earthen formation, comprising:

a face panel vertically disposed with a back face facing the earthen formation and preformed to include at least two anchors embedded in the face panel and extending from the back face in at least two predetermined locations on a horizontal line, a soil reinforcing mat horizontally disposed within the earthen formation in general correspondence with the predetermined locations, said mat having an end adjacent the face panel folded to form substantially a right angle portion of the mat including a vertical face and a horizontal face, wherein the anchors each include a vertical loop portion distal from the face panel and extending through openings in the vertical face of the right angle portion of the mat, and a rod inserted through the vertical loop portions, whereby the rod provides a single-piece means for securing the right angle portion of the mat to the face panel at the predetermined locations of the anchors embedded in the face panel.

5. The apparatus for retaining an earthen formation as in claim 4, further comprising:

a right angle member having a vertical face and a horizontal face disposed in contact with the corresponding vertical face and horizontal face of the right angle portion of the mat, and wherein the vertical loops also extend through openings in the vertical face of the right angle member.

6. A soil reinforced retaining wall, comprising, a face panel vertically disposed with a back face facing the earthen formation and preformed to include an anchor embedded in the face panel and extending orthogonally from the back face in at least one predetermined location, a reinforcing mat horizontally disposed within the earthen formation and having a plurality of longitudinal and transverse reinforcing members coupled to each other in a spaced orthogonal manner, wherein an end of the mat adjacent to the face panel has its longitudinal members folded along a fold line to form substantially a right angle portion of the mat having a horizontal face prior to the fold line and a vertical face after the fold line, a first right angle member having a vertical face and a horizontal face disposed in contact with the corresponding vertical face and horizontal face of the right angle portion of the mat, and means for securing the first right angle member to the anchor such that the right angle portion of the mat is rigidly clamped therebetween.

7. The soil reinforced retaining wall as in claim 6, wherein the vertical face of the right angle portion of the mat includes a last transverse member distal from the fold line and disposed in contact with a distal end of the right angle member, such that the last transverse member provides additional resistance to shear forces.

8. The soil reinforced retaining wall as in claim 7, wherein each longitudinal member on the vertical face of the right angle portion of the mat includes a protruding end folded over the distal end of the right angle member so as to provide additional resistance to shear forces.

9. A soil reinforced retaining wall, comprising, a face panel vertically disposed with a back face facing the earthen formation and preformed to include an anchor embedded in the face panel and extending orthogonally from the back face in at least one predetermined location, a reinforcing mat horizontally disposed within the earthen formation and having a plurality of longitudinal and transverse reinforcing members coupled to each other in a spaced orthogonal manner, wherein an end of the mat adjacent to the face panel has its longitudinal members folded along a fold line to form substantially a right angle portion of the mat having a horizontal face prior to the fold line and a vertical face after the fold line, first connection means affixed within the face panel and accessible from the back of the face panel, and a structural member disposed in contact with the right angle portion of the mat, and second connection means for securing the structural member to the first connection means such that the right angle portion of the mat is rigidly clamped therebetween.

10. An apparatus for retaining an earthen formation, comprising:

a face panel vertically disposed with a back facing the earthen formation and preformed to include at least two anchors embedded in the face panel and extending from the back face in at least two predetermined locations on a horizontal line, a soil reinforcing mat horizontally disposed within the earthen formation in general correspondence with the predetermined locations, said mat having an end adjacent the face panel folded to form substantially a right angle portion of the mat including a vertical face and a horizontal face, wherein each anchor comprises a flat plate affixed within the face panel and having a protruded portion extending from the back of the face panel including a first slot defining a horizontal opening, said protruded portion extending through a corresponding opening in the vertical face of the right angle portion of the mat to maintain the mat in alignment with the predetermined locations, and a rod inserted through the first slots to secure the vertical face of the right angle portion to the face panel.

11. The apparatus for retaining an earthen formation as in claim 10, wherein the soil reinforcing mat includes a last transverse member on its vertical face, and wherein each plate includes a second slot defining a vertical opening open to a top edge of the plate and adapted for receiving the last transverse wire therein to provide shear force resistance.

12. A method for constructing a soil reinforced retaining wall, comprising, providing a face panel having an anchor embedded therein and accessible from a back face in at least one predetermined horizontal location, providing a soil reinforcing mat having a plurality of longitudinal and transverse members coupled to each other in a spaced orthogonal manner, wherein an end of the mat adjacent to the face panel is folded along its longitudinal members to form substantially a right angle portion of the mat having a horizontal face and a vertical face, locating the face panel in a vertical orientation in front of an excavated area, filling and compacting the excavated area up to the predetermined horizontal location, placing the soil reinforcing mat in a horizontal orientation on the filled and compacted area such that the transverse members are parallel with the back of the face panel and the right angle portion of the mat is adjacent the face panel, placing a structural member in contact with the right angle portion of the mat, and securing the structural member to the anchor such that the right angle portion of the mat is rigidly clamped therebetween.

13. An apparatus for retaining an earthen formation, comprising:

a face panel vertically disposed with a back face facing the earthen formation and preformed to include an anchor embedded in the face panel and extending from the back face in at least one predetermined location, a soil reinforcing mat horizontally disposed within the earthen formation in general correspondence with the predetermined location, said mat having an end adjacent the face panel folded to form substantially a right angle portion of the mat including a vertical face and a horizontal face, a first right angle member having a vertical face and a horizontal face disposed in contact with the corresponding vertical face and horizontal face of the right angle portion of the mat, and wherein the anchor comprises a second right angle member having a vertical face affixed to the back of the face panel and a horizontal face extending from the back of the face panel, a T-anchor bracket having a longitudinal plate with one end coupled to the horizontal face of the second right angle member and another end coupled to a transverse plate, whereby the T-anchor provides means for securing the first right angle member to the anchor such that the right angle portion of the mat is rigidly held therebetween, and wherein the horizontal face of the first right angle member is coupled to the transverse plate such that the horizontal face of the right angle portion of the mat is rigidly held therebetween.

14. The apparatus for retaining an earthen formation as in claim 13, wherein the longitudinal plate of the T-anchor bracket is rotatably coupled at the one end to the horizontal face of the second right angle member.

15. The apparatus for retaining an earthen formation as in claim 14 wherein the longitudinal plate is rotatably coupled at the other end to the transverse plate.

16. The apparatus for retaining an earthen formation as in claim 14 wherein the longitudinal plate is fixedly coupled at the other end to the transverse plate.

17. The apparatus for retaining an earthen formation as in claim 13, wherein the anchor further comprises a stud embedded in the face panel and affixed to the second right angle member.

18. An apparatus for retaining an earthen formation, comprising:

a face panel vertically disposed with a back face facing the earthen formation and preformed to include an anchor embedded in the face panel and extending from the back face in at least one predetermined location, said anchor comprising a bolt embedded in the face panel and having a protruding portion including a threaded portion extending orthogonally from the back of the face panel, a soil reinforcing mat horizontally disposed within the earthen formation in general correspondence with the predetermined location, said mat having an end adjacent the face panel folded to form substantially a right angle portion of the mat including a vertical face and a horizontal face, a first right angle member having a vertical face and a horizontal face disposed in contact with the corresponding vertical face and horizontal face of the right angle portion of the mat, and means for securing the first right angle member to the anchor such that the right angle portion of the mat is rigidly held therebetween, and wherein the bolt extends through the vertical face of the right angle portion of the mat and through the vertical face of the first right angle member, the back face of the face panel includes a step adapted for supporting the mat and first right angle member, the securing means comprises a nut secured onto the threaded portion of the bolt such that the vertical face of the right angle portion of the mat is rigidly held between the vertical face of the first right angle member and the back of the face panel.

19. The apparatus for retaining an earthen formation as in claim 18, wherein the back face of the face panel includes a recess having a surface defining the step.

20. An apparatus for retaining an earthen formation, comprising:

a face panel vertically disposed with a back face facing the earthen formation and preformed to include an anchor embedded in the face panel and extending from the back face in at least one predetermined location, said anchor comprising a threaded insert embedded orthogonally in the face panel and having an opening on the back of the face panel, a soil reinforcing mat horizontally disposed within the earthen formation in general correspondence with the predetermined location, said mat having an end adjacent the face panel folded to form substantially a right angle portion of the mat including a vertical face and a horizontal face, a first right angle member having a vertical face and a horizontal face disposed in contact with the corresponding vertical face and horizontal face of the right angle portion of the mat, means for securing the first right angle member to the anchor such that the right angle portion of the mat is rigidly held therebetween, said means comprising a bolt inserted sequentially through the vertical face of the first right angle member, the vertical face of the soil reinforcing mat, and the opening into the threaded insert such that the vertical face of the right angle portion of the mat is rigidly held between the vertical face of the first right angle member and the back of the face panel, and wherein the back face of the face panel includes a step adapted for supporting the mat and the first right angle member.

21. The apparatus for retaining an earthen formation as in claim 20 wherein the back face of the face panel includes a recess having a surface defining the step.

22. An apparatus for retaining an earthen formation, comprising, a face panel vertically disposed with a back face facing the earthen formation and preformed to include at least two anchors embedded in the face panel and extending from the back face in at least two predetermined locations on a horizontal line, and wherein the face panel includes a step, a soil reinforcing mat horizontally disposed within the earthen formation in general correspondence with the predetermined locations, said mat having an end adjacent the face panel folded to form substantially a right angle portion of the mat including a vertical face and a horizontal face, and wherein the soil reinforcing mat includes a last transverse member on its vertical face, and wherein the anchors each include a vertical loop portion distal from the face panel and extending through openings in the vertical face of the right angle portion of the mat, and wherein each anchor comprises a flat plate embedded vertically in the face panel and extending from the back of the face panel such that a top edge thereof is in contact with the last transverse member and a bottom edge thereof is in contact with the step, and a rod inserted through the vertical loop portions.

23. The apparatus for retaining an earthen formation as in claim 22, wherein the back face of the face panel includes a recess having a surface defining the step.

24. A soil reinforced retaining wall, comprising, a face panel vertically disposed with a back face facing the earthen formation and preformed to include an anchor embedded in the face panel and extending orthogonally from the back face in at least one predetermined location, a reinforcing mat horizontally disposed within the earthen formation and having a plurality of longitudinal and transverse reinforcing members coupled to each other in a spaced orthogonal manner, wherein an end of the mat adjacent to the face panel has its longitudinal members folded along a fold line to form substantially a right angle portion of the mat having a horizontal face prior to the fold line and a vertical face after the fold line, a first right angle member having a vertical face and a horizontal face disposed in contact with the corresponding vertical face and horizontal face of the right angle portion of the mat, and wherein the anchor comprises a second right angle member having a vertical face affixed to the back of the face panel and a horizontal face extending from the back of the face panel, means for securing the first right angle member to the anchor such that the right angle portion of the mat is rigidly held therebetween, said securing means comprising a T-anchor bracket having a longitudinal plate with one end coupled to the horizontal face of the second right angle member and another end coupled to a transverse plate, and wherein the horizontal face of the first right angle member is coupled to the transverse plate such that the horizontal face of the right angle portion of the mat is rigidly held therebetween.

25. A soil reinforced retaining wall, comprising, a face panel vertically disposed with a back face facing the earthen formation and preformed to include an anchor embedded in the face panel and extending orthogonally from the back face in at least one predetermined location, a reinforcing mat horizontally disposed within the earthen formation and having a plurality of longitudinal and transverse reinforcing members coupled to each other in a spaced orthogonal manner, wherein an end of the mat adjacent to the face panel has its longitudinal members folded along a fold line to form substantially a right angle portion of the mat having a horizontal face prior to the fold line and a vertical face after the fold line, a first right angle member having a vertical face and a horizontal face disposed in contact with the corresponding vertical face and horizontal face of the right angle portion of the mat, and wherein the anchor comprises a clip extending from the back face of the face panel, through an opening in the vertical face of the first right angle member, and between selected longitudinal and transverse members, and means for securing the first right angle member to the anchor such that the right angle portion of the mat is rigidly held therebetween, said securing means comprising means for coupling the vertical face of the first right angle member to the clip such that the vertical face of the right angle portion of the mat is rigidly held against the back face of the face panel.

26. The soil reinforced retaining wall as in claim 25, wherein the clip is a J-bolt affixed within the face panel and having a threaded portion extending from the back of the face panel and through a corresponding opening in the vertical face of the first right angle member, and wherein the coupling means is a washer and a nut screwed onto the J-bolt to secure the right angle member in place.

27. The soil reinforced retaining wall as in claim 25, wherein the clip is a threaded insert affixed within the face panel, and wherein the coupling means is a bolt inserted through a washer and a corresponding opening in the first right angle member then screwed into the insert.

28. The soil reinforced retaining wall as in claim 25.

wherein the clip is a U-shaped clip affixed on its side within the face panel such that a looped portion thereof defining an horizontal opening extends from the back of the face panel and through a corresponding opening in the vertical face of the right angle member, and wherein the securing means is a pin inserted through the looped portion of the clip and secured against the vertical face of the first right angle member.

* * * * *